United States Patent [19]

Shirasaki et al.

[11] Patent Number: 4,956,259

[45] Date of Patent: Sep. 11, 1990

[54] SPHERICAL ELECTROPHOTOGRAPHIC TONER PARTICLES COMPRISING CARBON AND PREPARATION THEREOF

[75] Inventors: Yoshitsugu Shirasaki; Yoshiaki Torimoto, both of Wakayama, Japan

[73] Assignee: Kao Corporation, Tokyo, Japan

[21] Appl. No.: 73,266

[22] Filed: Jul. 14, 1987

[30] Foreign Application Priority Data

Jul. 14, 1986 [JP] Japan ..... 61-165304

[51] Int. Cl.[5] ..... G03G 9/08

[52] U.S. Cl. ..... 430/137; 423/445; 423/461

[58] Field of Search ..... 430/109, 111, 137; 423/445, 461

[56] References Cited

U.S. PATENT DOCUMENTS 3,391,082 7/1968 Maclay ..... 430/137 X
3,830,750 8/1974 Wellman ..... 430/137
3,890,240 6/1975 Hochberg ..... 430/114 X
4,259,426 3/1981 Hasegawa et al. ..... 430/111 X
4,514,487 4/1985 Kasuya et al. ..... 430/137
4,804,610 2/1989 Mori ..... 430/137

FOREIGN PATENT DOCUMENTS 2727890 2/1978 Fed. Rep. of Germany .

OTHER PUBLICATIONS

Patent Abstracts of Japan, vol. 8, No. 219 (p-306).
Patent Abstracts of Japan, vol. 7, No. 78 (p-188).

*Primary Examiner*—J. David Welsh
*Attorney, Agent, or Firm*—Birch, Stewart, Kolasch & Birch

[57] ABSTRACT

A toner composition having particles substantially in the spherical form and comprises a binder resin and carbon black having a number-average particle size of 20 to 500 millimicrons and a standard deviation of particle size distribution of 70 millimicrons or smaller.

3 Claims, No Drawings

SPHERICAL ELECTROPHOTOGRAPHIC TONER PARTICLES COMPRISING CARBON AND PREPARATION THEREOF

The present invention relates to a toner for developing an electrostatically charged image in electrophotography, electrostatic recording or electrostatic printing.

Up to this time, an electrostatically charged image formed on a recording medium in electrophotography, electrostatic recording or electrostatic printing has been developed by two main methods, i.e., a wet developing method using a developer comprising a fine dispersion of various pigments or dyes in an insulating liquid or a dry developing method using a finely powdered developer which is a so-called toner and prepared by dispersing a coloring material in a natural or synthetic resin. Examples of the latter method include cascade method, manual brushing, magnetic brushing, impression method and powder cloud method. The present invention relates to a toner suitable for this dry developing method.

Up to this time, a toner for developing an electrostatically charged image has been prepared by dispersing a coloring material in a soft polymer by melting and kneading and grinding the obtained polymer containing the coloring material dispersed therein. However, the powder obtained by this process has a very wide particle size distribution, so that the powder must be classified prior to the practical use as a toner. Thus, the process itself is disadvantageous in complexity and cost.

Further, the toner prepared by the above process involving a grinding step has edges and small cracks. Therefore, the toner is poor in fluidity and when it is stirred in a developing device, these edges and small cracks are broken to generate dust which causes lowering in the quality of an image, or scumming, thus shortening the life of the image.

On the other hand, several polymerization processes for directly preparing a colored polymer particle not involving any grinding step have been proposed in, for example, Japanese Patent Publication Nos. 10231/1961, 51830/1972 and 14895/1976 and Japanese Patent Laid-Open Nos. 17735/1978, 17736/1978 and 17737/1978.

These processes comprise suspending an oily phase containing a monomer, a polymerization initiator and a coloring material in an aqueous medium and polymerizing the obtained suspension to directly obtain a toner and relate to so-called suspension polymerization.

These processes have advantages in that the obtained toner is spherical and excellent in fluidity and that the preparation process itself is simple and the cost is low.

However, the toner prepared by these processes is disadvantageous in view of the electrostatic chargeability and durability of electrostatic charge even at normal temperature and at the normal humidity and provides no good image.

The inventors of the present invention have studied on the reason for the above disadvantages and, as a result of the study, the reason is estimated as follows: since carbon black which has been uniformly dispersed among monomers at the initiation of the suspension polymerization agglomerates again by the interaction during the polymerization to give a toner particle exhibiting ununiform electrostatic chargeability. Therefore, it is disadvantageous that such a toner does not provide an even image.

The inventors;,of the present invention have undergone extensive investigations to overcome the above disadvantages. The inventors of the present have found that the disadvantages can be overcome by employing a spherical toner particle characterized in that carbon black dispersed in the toner particle has a number-average particle size within a specified range and a standard deviation of particle size distribution not exceeding a specified value. The present invention has been accomplished on the basis of this finding.

A toner composition of the invention is particles substantially in the spherical form and comprises a binder resin and carbon black having a number-average particle size of 20 to 500 millimicrons and a standard deviation of particle size distribution of 70 millimicrons or smaller.

It is produced by dispersing carbon black, a polymerization initiator, a charge controller and a hydrophobic dispersant in a polymerizable unsaturation monomer obtain the oily phase, adding the resulting oily phase into water containing a dispersion stabilizer to obtain a dispersion, agitating the dispersion with so high a rate as to result in very fine particles of the oil phase, polymerizing the dispersion and recovering the obtained toner particles. It is preferable that the oil phase further contains a thickening agent.

The hydrophobic dispersant includes, for example, an inorganic dispersant such as calcium silicate, silicon carbide and magnesium silicate and an organic dispersant such as an alkenyl succinic imide, polyethyleneimine and derivatives thereof.

The thickening agent includes, for example, aluminum dialkyl phosphate, aluminum stearate, 12-hydroxystearic acid and dibenzylidene sorbitol and other conventional thickening agents and conventional gelatin agents. The polymer being soluble in the monomer may be used. It serves to prevent carbon black from moving and agglomerating during the, polymerization step. It is preferable in that it is free of trouble due to electric charging.

The term "spherical toner" used in this specification refers not only to the those having a genuine sphere but also to the those having a distorted sphere such as cocoon-like shape. That is to say, the spherical toner particles according to the present invention may have microscopic edges or undulations so long as it does not have any macroscopic edge on its surface.

The dispersion properties of the carbon black present in a toner (and on the surface thereof) are determined as follows:

Toner particles are added to an epoxy resin. The resulting resin is cut into thin films each having a thickness of several hundreds of Å. The thin film is photographed with an electron microscope of the transmission type. The obtained photograph is analyzed for the state (dispersiblity, agglomeration, number of particles and the like) of carbon black with an image analyzer. Based on the size and number of carbon black particles present in the toner particle which have been determined by analyzing the photograph with an image analyzer, the standard deviation ($\sigma$) of particle size distribution of carbon black present in the toner particle is calculated according to the following equation:

$$\sigma = \sqrt{\sum_{i=1}^{N} (D_{AU} - D_i)^2/N}$$

wherein $D_{AU}$; number-average particle size $D_i$; size of the i-th particle

N; number of particles

The spherical toner according to the present invention can be prepared by suspension polymerization. An oily dispersion obtained by dispersing a polymerization initiator, a charge controller, carbon black and the above shown additive(s) in $\alpha,\beta$-unsaturated monomer is added to an aqueous medium obtained by homogeneously dissolving a water-soluble polymer or dispersing a suspension stabilizer such as an inorganic salt which is difficultly water-soluble. The resulting mixture is homogenized with a homomixer or homogenizer to form an oily disperse phase of 5 to 30 μm. The weight ratio of the oily phase to the aqueous phase is between 1:2 and 1:10 and is so selected as not to cause cohesion of particles during polymerization. The homogeneous O/W dispersion thus prepared is transferred to a separable flask fitted with a stirrer, a condenser, a thermometer and a nitrogen gas inlet tube and heated to a temperature (50° to 90° C.), at which the polymerization initiator can be decomposed, in a nitrogen atmosphere to carry out the polymerization.

After the completion of the polymerization, the polymerization mixture is filtered to remove the aqueous phase. When inorganic powder adheres to the surface of a product, the product is treated with a dilute acid to remove the powder. The resulting product is washed with water and dried by spray drying, vacuum drying or the like to obtain an objective toner.

The $\alpha,\beta$-unsaturated monomer to be used in the present invention may be any one. Examples thereof include styrene, p-chlorostyrene, p-methylstyrene, vinyl acetate, vinyl propionate, vinyl benzoate, methyl acrylate, ethyl acrylate, n-butyl acrylate, iso-butyl acrylate, 2-ethylhexyl acrylate, lauryl acrylate, n-octyl acrylate, methyl methacrylate, ethyl methacrylate, n-butyl methacrylate, iso-butyl methacrylate, lauryl methacrylate, diethylaminoethyl methacrylate, t-butylaminomethyl mathacrylate, acrylonitrile, 2-vinylpyridine and 4-vinylpyridine. These monomers may be used alone or as a mixture of two or more.

According to the present invention, a polyfunctional monomer may be used as a crosslinking agent in addition to the above monomer to thereby further enhance the endurance of a toner. The amount of the polyfunctional monomer used may be 0.05 to 20% by weight, preferably 0.5 to 5% by weight based on the monomer.

The polymerization initiator to be used in the present invention may be an ordinary oil-soluble peroxide or azo initiator. Examples thereof include benzoyl peroxide, lauroyl peroxide, 2,2'-azobisisobutyronitrile, 2,2'-azobis(2,4-dimethylvaleronitrile), o-chlorobenzoyl peroxide and o-methoxybenzoyl peroxide. The polymerization initiator may be used in an amount of 0.1 to 10% by weight, preferably 0.5 to 5% by weight based on the monomer.

Examples of the suspension stabilizer to be used in the present invention include water-soluble polymers such as gelatin, starch, hydroxyethylcellulose, carboxymethylcellulose, polyvinylpyrrolidone, polyvinyl alkyl ether and polyvinyl alcohol and inorganic salts which are difficultly soluble in water such as barium sulfate, calcium sulfate, barium carbonate, calcium carbonate, magnesium carbonate and calcium phosphate. The suspension stabilizer may be used in an amount of 0.1 to 5% by weight, preferably 0.5 to 2% by weight based on the water.

The toner according to the present invention may further contain a low-molecular weight olefin polymer which is known as a so-called parting agent with the purpose of the inhibition of offset and the improvement in fludity and fixability.

It is preferable that this low-molecular weight olefin polymer is present in the polymerization system together with a coloring material.

Examples of the low-molecular weight olefin polymer to be used in the toner of the present invention include polyethylene, polypropylene, ethylene-vinyl acetate copolymer, chlorinated polyethylene wax, polyamide, polyester, polyurethane, polyvinyl butyral, butadiene rubbers, phenolic resins, epoxy resins, rosin-modified resins, silicone oil and silicone wax.

The toner obtained in the present invention preferably has a softening point of 106° to 160° C. and a glass transition temperature of 50° to 80° C. If the softening point is lower than 106° C., no sufficient non-offset range will be attained, while if the point exceeds 160° C., the minimum fixing temperature will be too high and other unfavorable phenomena will occur. On the other hand, if the glass transition temperature is lower than 50° C., the resulting toner will be poor in storage stability, while if it exceeds 80° C., the fixability will be unfavorably lowered.

Although the carbon black to be used in the present invention is not particularly limited and may be any commercially available one, it is preferable to use a hydrophobic carbon black having low-oil absorbing power, because the use of such carbon black enables the easy preparation of the toner of the present invention.

Carbon black is generally present in a toner particle as a secondary agglomerate rather than in a monodispersed state. According to the present invention, the carbon black dispersed in the toner must have a number-average particle size of 20 to 500 mμ, preferably 20 to 100 mμ. Further, the dispersion properties of carbon black particles are generally evaluated by the standard deviation thereof. According to the present invention wherein the number-average particle size is 20 to 500 mμ, the standard deviation must be not more than 70 mμ, preferably not more than 50 mμ, more preferably 30 mμ. A spherical toner particle having such dispersion properties is provided by the invention for the first time.

As described above, the toner of the prior art obtained by grinding has disadvantages in that it is poor in fluidity and that the breakage of the toner proceeds in service to cause scumming or lowering in the quality of the resulting image, thus shortening the life of the developer. On the other hand, although the spherical toners proposed in the above Japanese Patent Publication and Laid-Open are free from the above disadvantages, they exhibit unstable changing characteristics, so that the charge thereof varies in prolonged service. Further, the image formed by using them exhibits quality and reproducibility of halftone dots inferior to those of the image formed by using the toner prepared by grinding.

Since the spherical toner according to the present invention exhibits excellent charge stability and fluidity and is not broken in service, no dust generates and therefore neither scumming nor lowering in the quality of the image occurs. Such a toner particle is now provided by the present invention for the first time.

The present invention will be described in more detail by the following Examples, though it is not limited to them. In the Examples, all parts are by weight.

EXAMPLE 1

85 parts of styrene, 15 parts of lauryl methacrylate (LMA), 2 parts of a charge controller (TRH, a product of Hodogaya Chemical Co., Ltd.), 0.5 parts of aluminum stearate, 8 parts of carbon black (Printex 150T; a product of DEGUSSA) and 3 parts of polyethylene wax (a product of Mitsui Petrochemical Industries, Ltd ; 210 P) were mixed to obtain a mixture.

500 parts of water and 1 part of polyvinyl alcohol were added to 100 parts of the mixture. The obtained mixture was homogenized by stirring at a high rate of 10,000 rpm with a homomixer (a product of Tokushu Kakoki Co., Ltd. ; TK) to obtain a fine dispersion. This dispersion was transferred to a separable flask fitted with stirring blades to carry out the suspension polymerization at 60° C. for 9 hours. The polymerization mixture was washed with hot water of 50° C. and dried to obtain a toner.

0.5 g of the toner was homogeneously dispersed in a liquid mixture comprising 9.3 ml of an epoxy resin (Epoc 812), 4.0 ml of dodecenylsuccinic anhydride (DDSA), 6.7 ml of methyl nadic anhydride (MNA) and 0 3 ml of tri(dimethylaminomethyl)phenol (DMP-30). The obtained dispersion was allowed to stand at an ordinary temperature for 2 days.

The obtained toner-containing epoxy resin was cut into thin films having a thickness of several hundreds of Å with a microtome (a product of Nissei Sangyo Co., Ltd.; MT2-B). The thin film sample was subjected to electron microscopy with an electron microscope the transmission type (a product of JOEL, Ltd.).

The obtained electron microscope photograph was analyzed with an image analyzer (a product of Nippon Regulator Co., Ltd.,: LUZEX-500) for the dispersed state of carbon black in the crosssection of the toner.

The carbon black dispersed in the toner had a number-average particle size of 88 mμ and a standard deviation of 18.1 mμ.

A developer was prepared by the use of the toner and a commmercially available ferrite carrier having a particle size distribution of 150/250 mesh at a toner/carrier ratio of 4/96 and applied to a duplicating machine (Ricoh FT 4060). The obtained image was evaluated.

A clear image free from fogging and scumming was obtained under an environmental condition of 25° C. and 50% humidity.

Further, the printing using the above developer was repeated 20,000 times. Good images were obtained until the last printing without any change in the quantity of charge.

EXAMPLE 2

85 parts of styrene, 15 parts of LMA, 2 parts of a charge controller (a product of Hodogaya Chemical Co., Ltd.; TRH), 8 parts of carbon black (a product of Mitsubishi Chemical Industries, Ltd.; #44), 0.5 part of silicon carbide and 3 parts of polyethylene wax (a product of Mitsui Petrochemical Industries, Ltd.; 210 P) were mixed to obtain a mixture.

500 parts of water and 1 part of polyvinyl alcohol were added to 100 parts of the mixture. The obtained mixture was homogenized by stirring at a high rate of 10,000 rpm with a homomixer (a product of Tokushu Kakoki Co., Ltd.; TK) to obtain a fine dispersion. This dispersion was transferred to a separable flask fitted with stirring blades to carry out the suspension polymerization at 60° C. for 9 hours. The polymerization mixture was washed with hot water of 50° C. and dried to obtain an objective toner.

0.5 g of the toner was homogeneously dispersed in a liquid mixture comprising 9.3 ml of an epoxy resin (Epoc 812), 4.0 ml of DDSA, 6.7 ml of MNA and 0.3 ml of DMP-30. The obtained dispersion was allowed to stand at an ordinary temperature for two days.

The obtained toner-containing epoxy resin was cut into thin films having a thickness of several hundreds of Å with a microtome (a product of Nissei Sangyo Co., Ltd.; MT2-B). This thin film sample was subjected to electron microscopy with an electron microscope of the transmission type (a product of JEOL, Ltd.).

The obtained electron microscope photograph was analyzed with an image analyzer (a product of Nippon Regulator, Co., Ltd.; LUZEX-500) for the dispersed state of carbon black in the crosssection of the toner.

The carbon black dispersed in the toner had a number-average particle size of 120 mμ and a standard deviation of 27.5 mμ.

A developer was prepared by the use of the toner and a commercially available ferrite carrier having a particle size distribution of 150/250 mesh at a toner/carrier ratio of 4/96 and applied to a duplicating machine (Ricoh FT 4060). The obtained image was evaluated.

A clear image free from fogging and scumming was obtained under an environmental condition of 25° C. and 50% humidity.

The printing using the above developer was repeated fifty thousand times. Good images were obtained until the last printing without any change in the quantity of charge.

EXAMPLE 3

85 parts of styrene, 15 parts of 2-ethylhexyl acrylate (2EHA), 2 parts of a charge controller (a product of Hodogaya Chemical Co., Ltd.; TRH), 8 parts of carbon black (a product of DEGUSSA; Printex 150T), 5 parts of a copolymer of 85 parts of styrene and 15 parts of 2-ethylhexyl acrylate having a molecular weight of 100,000 as a thickening agent and 3 parts of polyethylene wax (a product of Mitsui Petrochemical Industries, Ltd.; 210P) were mixed to obtain a mixture.

500 parts of water and 1 part of polyvinyl alcohol were added to 100 parts of the mixture. The obtained mixture was homogenized by stirring at a high rate of 10,000 rpm with a homomixer (a product of Tokushu Kakoki Co., Ltd.; TK) to obtain a fine dispersion. This dispersion was transferred to a separable flask fitted with stirring blades to carry out the suspension polymerization at 60° C. for 9 hours. The polymerization mixture was washed with hot water of 50° C. and dried to obtain an objective toner.

0.5 g of the toner was homogeneously dispersed in a liquid mixture comprising 9.3 ml of an epoxy resin (Epoc 812), 4.0 ml of DDSA, 6.7 ml of MNA and 0.3 ml of DMP-30. The obtained dispersion was allowed to stand at an ordinary temperature for two days.

The obtained toner-containing epoxy resin was cut into thin films having a thickness of several hundreds of Å with a microtome (a product of Nissei Sangyo Co., Ltd.; MT2-B). This thin film sample was subjected to electron microscopy with an electron microscope of the transmission type (a product of JEOL, Ltd.)

The obtained electron microscope photograph was analyzed with an image analyzer (a product of Nippon Regulator, Co., Ltd.; LUZEX-500) for the dispersed state of carbon black in the crosssection of the toner.

The carbon black dispersed in the toner had a number-average particle size of 144 mμ and a standard deviation of 48.1 mμ.

A developer was prepared by the use of the toner and a commercially available ferrite carrier having a particle size distribution of 150/250 mesh at a toner/carrier ratio of 4/96 and applied to a duplicating machine (Ricoh FT 4060). The obtained image was evaluated.

A clear image free from fogging and scumming was obtained under an environmental condition of 25° C. and 50% humidity.

The printing using the above developer was repeated 40,000 times. Good images were obtained until the printing without any change in the quantity of charge.

COMPARATIVE EXAMPLE 1

Eighty five parts of styrene, fifteen parts of 2-ethylhexyl acrylate, 2 parts of a charge controller (a product of Hodogaya Chemical Co., Ltd.; TRH), 8 parts of carbon black (a product of Mitsubishi Chemical Industries, Ltd.; #44) and 2 parts of polyethylene wax (Mitsui Petrochemical Industries, Ltd.; 210P) were mixed to obtain a mixture.

500 parts of water and 1 part of polyvinyl alcohol were added to 100 parts of the mixture. The obtained mixture was homogenized by stirring at a high rate of 10,000 rpm with a homomixer (a product of Tokushu Kakoki Co., Ltd.; TK) to obtain a fine dispersion. This dispersing was transferred to a separable flask fitted with stirring blades to carry out the suspension polymerization at 60° C. for 9 hours. The polymerization mixture was washed with hot water of 50° C. and dried to obtain a control toner.

0.5 g of the toner was homogeneously dispersed in a liquid mixture comprising 9.3 ml of an epoxy resin (Epoc 812) 4.0 ml of DDSA, 6.7 ml of MNA and 0.3 ml of DMP-30. The obtained dispersion was allowed to stand at an ordinary temperature for two days.

The obtained toner-containing epoxy resin was cut into thin films having a thickness of several hundreds of Å with a microtome (a product of Nissei Sangyo Co., Ltd.; MT2-B). This thin film sample was subjected to electron microscopy with an electron microscope of the transmission type (a product of JEOL, Ltd.)

The obtained electron microscope photograph was analyzed with an image analyzer (a product of Nippon Regulator, Co., Ltd.: LUZEX-500) for the dispersed state of carbon black in the crosssection of the toner.

The carbon black dispersed in the toner had a number-average particle size of 225 mμ and a standard deviation of 74.1 mμ.

A developer was prepared by the use of the toner and a commercially available ferrite carrier having a particle size distribution of 150/250 mesh at a toner/carrier ratio of 4/96 and applied to a duplicating machine (Ricoh FT4060). The obtained image was evaluated.

An unclear and uneven image was obtained under an environmental condition of 25° C. and 50% humidity.

The printing using the above developer was repeated ten thousand times. The charge of the toner was lowered, so that the quantity of the obtained image was also lowered.

What is claimed is:

1. A process for preparing a toner composition containing substantially spherical particles, said spherical particles comprising a binder resin and, dispersed in said binder resin, carbon black having a number-average particle size of 20 to 500 millimicrons and a standard deviation of particle size distribution of 70 millimicrons or smaller, which comprises the steps of (a) dispersing carbon black, a polymerization initiator, a charge controller and one or both of a hydrophobic dispersant and a binder resin in an unsaturated polymerizable monomer to obtain an oily phase, (b) adding said resultant oily phase into water containing a dispersion stabilizer to obtain a dispersion, (c) agitating the dispersion at a high rate, (d) polymerizing the dispersion; and (e) recovering the thus obtained toner particles.

2. The toner composition produced by the process of claim 1.

3. The process according to claim 1 further comprising adding a thickening agent during step (a).

* * * * *